US008857816B2

(12) United States Patent
Martineck, Sr.

(10) Patent No.: US 8,857,816 B2
(45) Date of Patent: Oct. 14, 2014

(54) LOTTERY INSTANT-GAME TICKET

(71) Applicant: Scientific Games International, Inc., Newark, DE (US)

(72) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 14/154,456

(22) Filed: Jan. 14, 2014

(65) Prior Publication Data

US 2014/0123464 A1 May 8, 2014

Related U.S. Application Data

(62) Division of application No. 11/801,526, filed on May 10, 2007, now Pat. No. 8,628,082.

(60) Provisional application No. 60/799,543, filed on May 11, 2006.

(51) Int. Cl.
*A63F 3/06* (2006.01)

(52) U.S. Cl.
CPC ..... *A63F 3/0605* (2013.01); *A63F 3/0065* (2013.01); *Y10S 283/903* (2013.01); *Y10S 283/901* (2013.01)
USPC ..... 273/139; 273/138.1; 273/269; 463/17; 463/18; 463/19; 283/72; 283/94; 283/111; 283/901; 283/903; 427/288

(58) Field of Classification Search
CPC ..... A63F 3/065; Y10S 283/903
USPC ..... 273/138.1, 139, 269; 283/72, 94, 111, 283/901, 903; 463/17, 18, 19; 427/288
See application file for complete search history.

(56) References Cited

U.S. PATENT DOCUMENTS

| | | | | | |
|---|---|---|---|---|---|
| 3,918,174 | A | * | 11/1975 | Miller et al. | 434/346 |
| 4,466,614 | A | * | 8/1984 | Bachman et al. | 273/139 |
| 4,491,319 | A | * | 1/1985 | Nelson | 273/459 |
| 5,074,566 | A | * | 12/1991 | Desbiens | 273/269 |
| 5,118,109 | A | * | 6/1992 | Gumina | 273/139 |
| 5,193,815 | A | * | 3/1993 | Pollard | 273/269 |
| 5,451,052 | A | * | 9/1995 | Behm et al. | 273/139 |
| 5,671,921 | A | * | 9/1997 | Quinlan | 273/139 |
| 5,743,524 | A | * | 4/1998 | Nannicola | 273/139 |
| 5,782,470 | A | * | 7/1998 | Langan | 273/139 |
| 5,887,906 | A | * | 3/1999 | Sultan | 283/94 |
| 6,076,860 | A | * | 6/2000 | Holman et al. | 283/109 |

(Continued)

*Primary Examiner* — Gene Kim
*Assistant Examiner* — Alexander Niconovich
(74) *Attorney, Agent, or Firm* — Dority & Manning, P.A.

(57) ABSTRACT

A lottery instant-game ticket and method of making same. On a substrate is placed a first set of game indicia including a first set of game symbols, and a second set of indicia larger than the first set of game indicia and including a second set of game symbols, and includes any winning symbol. A subset of the second set of game indicia with each symbol including a non-winning indicator. The first set and second of game indicia are covered with a removable covering, with the covering having position indicators positioned substantially over each of the first set of game indicia, and identical game symbols positioned substantially over a corresponding identical game symbol of the second set of game indicia such that removal of the identical game symbol reveals the identical game symbol of the second set of game indicia and any non-winning indicator, if present.

8 Claims, 3 Drawing Sheets

(56) References Cited

U.S. PATENT DOCUMENTS

| | | | | |
|---|---|---|---|---|
| 6,224,055 | B1 * | 5/2001 | Walker et al. | 273/139 |
| 6,237,913 | B1 * | 5/2001 | Kamille | 273/139 |
| 6,241,246 | B1 * | 6/2001 | Guttin et al. | 273/139 |
| 6,270,406 | B1 * | 8/2001 | Sultan | 463/17 |
| 6,273,817 | B1 * | 8/2001 | Sultan | 463/17 |
| 6,379,742 | B1 * | 4/2002 | Behm et al. | 427/7 |
| 6,390,916 | B1 * | 5/2002 | Brown | 463/17 |
| 6,588,747 | B1 * | 7/2003 | Seelig | 273/138.1 |
| 6,612,576 | B1 * | 9/2003 | Stancik et al. | 273/139 |
| 6,676,126 | B1 * | 1/2004 | Walker et al. | 273/139 |
| 7,004,506 | B2 * | 2/2006 | Downes et al. | 283/62 |
| 7,028,907 | B2 * | 4/2006 | Collins et al. | 235/470 |
| 7,311,599 | B2 * | 12/2007 | Knapp | 463/17 |
| 7,422,213 | B2 * | 9/2008 | Katz et al. | 273/138.1 |
| 7,458,580 | B2 * | 12/2008 | Martineck et al. | 273/139 |
| 8,308,162 | B2 * | 11/2012 | Rogers | 273/139 |
| 8,333,380 | B2 * | 12/2012 | Berkowitz | 273/139 |
| 2002/0109294 | A1 * | 8/2002 | Gauthier et al. | 273/139 |
| 2004/0053011 | A1 * | 3/2004 | Behm et al. | 428/195 |
| 2004/0201169 | A1 * | 10/2004 | Schaefer et al. | 273/139 |
| 2005/0167910 | A1 * | 8/2005 | Candler | 273/138.1 |
| 2008/0042426 | A1 | 2/2008 | Martineck | |

* cited by examiner

LOTTERY INSTANT-GAME TICKET

CROSS-REFERENCE TO RELATED APPLICATION

The present application is a Divisional application of U.S. application Ser. No. 11/801,526, filed May 10, 2007, which claims the benefit of U.S. Provisional Patent Application Ser. No. 60/799,543, filed on May 11, 2006, the entirety of which is hereby incorporated herein by this reference.

BACKGROUND OF THE INVENTION

1. Field of the Invention

The invention relates generally to an instant-game ticket for a lottery or other promotional type of game. More specifically, the invention relates to an improved scratch-off type lottery game card and game.

2. Description of the Related Art

Many governments and/or gaming organizations sponsor wagering games known as lotteries, and which may also include promotional games. Lottery games have become an important source of income to governments as they shoulder much of the financial burden for education and other social welfare programs. However, as governments have grown more dependent on lotteries, it has become a challenge to sustain public interest therein as game players tend to seek new types and styles of games not previously seen.

One approach to invigorating lottery game sales has been to expand game content beyond traditional games in the hope that the new games will help keep current players as lottery game players, as well as draw in new game players for increasing lottery revenues for use in the public good. However, the game play of the instant ticket needs to remain simple such that the method of play and determination of a winning ticket are straightforward and readily comprehensible.

Among scratch-off lottery games, simple win-lose games are well known and have been played for a number of years such that players are less excited about playing these games than they may have been in the past, which would have the effect of reducing sales of the game. What is needed, therefore, is a new scratch-ticket play style that will excite traditional instant-game ticket game players and potentially entice new players to purchase tickets. It is thus to such an improved instant-game ticket that the present invention is primarily directed.

SUMMARY OF THE INVENTION

The present invention is an instant-game ticket and method of making the ticket. The lottery instant-game ticket includes a substrate having a first set of game indicia placed on the substrate, with the first set of game indicia comprised of a first set of game symbols. The substrate includes a second set of indicia larger than the first set of game indicia and comprised of a second set of game symbols, with a subset of the second set of game symbols identical to a subset of the first set of game symbols, and a subset of the second set of game indicia each including a non-winning indicator. The first set of game indicia is covered with a removable covering that includes position indicators that are positioned substantially over each of the first set of game indicia such that removal of the removable material at the position indicator reveals a game symbol of the first set of game indicia. The second set of game indicia is covered with a removable covering that contains identical game symbols to the second set of game symbols, with the identical game symbols positioned substantially over a corresponding identical game symbol of the second set of game indicia whereby removal of the identical game symbol on the removable material will reveal the identical game symbol of the second set of game indicia and corresponding non-winning indicator, if present. Upon removal of the removable material over the second set of game indicia, a winning ticket is indicated by at least one winning game symbol present in the second set of game indicia.

The invention also includes a method for making an instant-game ticket through placing a first set of game indicia on a substrate, with the first set of game indicia including a first set of game symbols, and then placing a second set of indicia on the substrate larger in number than the first set of game indicia and comprised of a second set of game symbols, with a subset of the second set of game symbols identical to a subset of the first set of game symbols, and a subset of the second set of game indicia each including a non-winning indicator. The method then has the step of covering the first set of game indicia with a removable covering that includes position indicators that are positioned substantially over each of the first set of game indicia such that removal of the removable material at the position indicator reveals a game symbol of the first set of game indicia, and covering the second set of game indicia with a removable covering that contains identical game symbols to the second set of game symbols, with the identical game symbols positioned substantially over a corresponding identical game symbol of the second set of game indicia such that removal of the identical game symbol on the removable material will reveal the identical game symbol of the second set of game indicia and corresponding non-winning indicator, if present.

The present invention therefore provides an advantage in that the lottery instant-game ticket provides a novel method of play that will entice customers to purchase and play the ticket. The instant-game ticket is simple to play and readily conveys to the player whether the ticket is winning.

Other objects, features, and advantages of the present invention will become apparent after review of the hereinafter set forth Brief Description of the Drawings, Detailed Description of the Invention, and the Claims.

DETAILED DESCRIPTION OF THE INVENTION

Figure 1A:
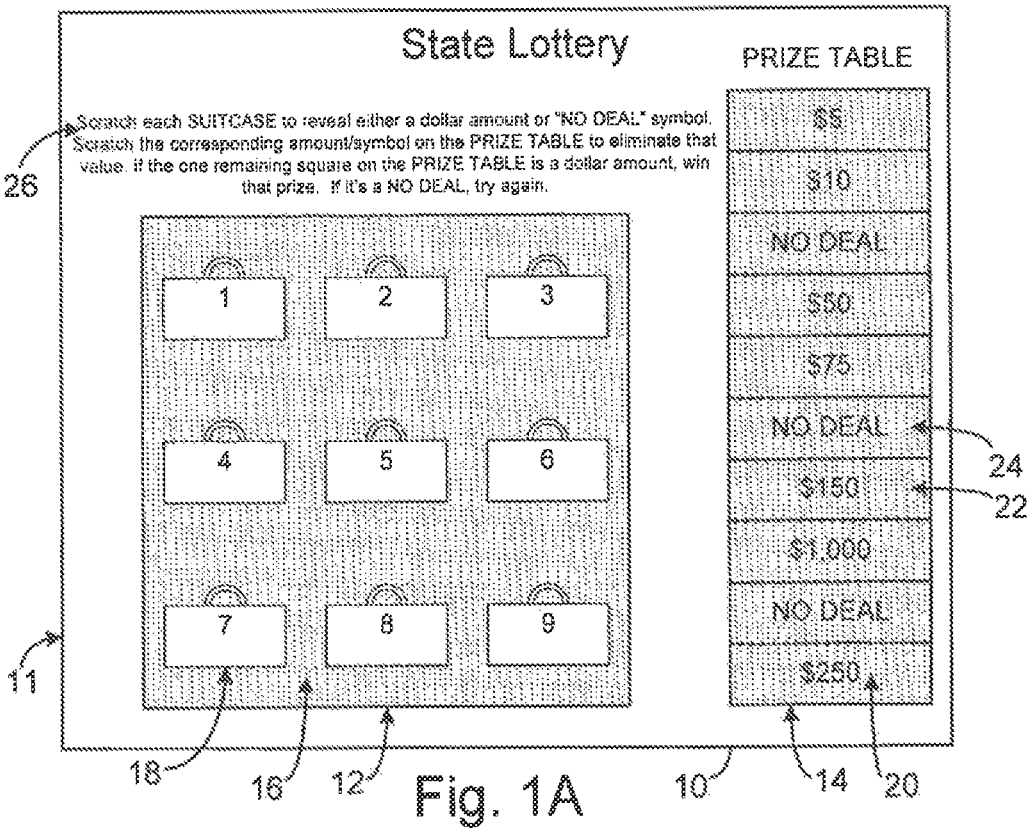
FIG. 1A is an illustration of one embodiment of lottery instant-game ticket of the present invention with the variably imaged game data concealed by a removable scratch-off coating.
Figure 1B:
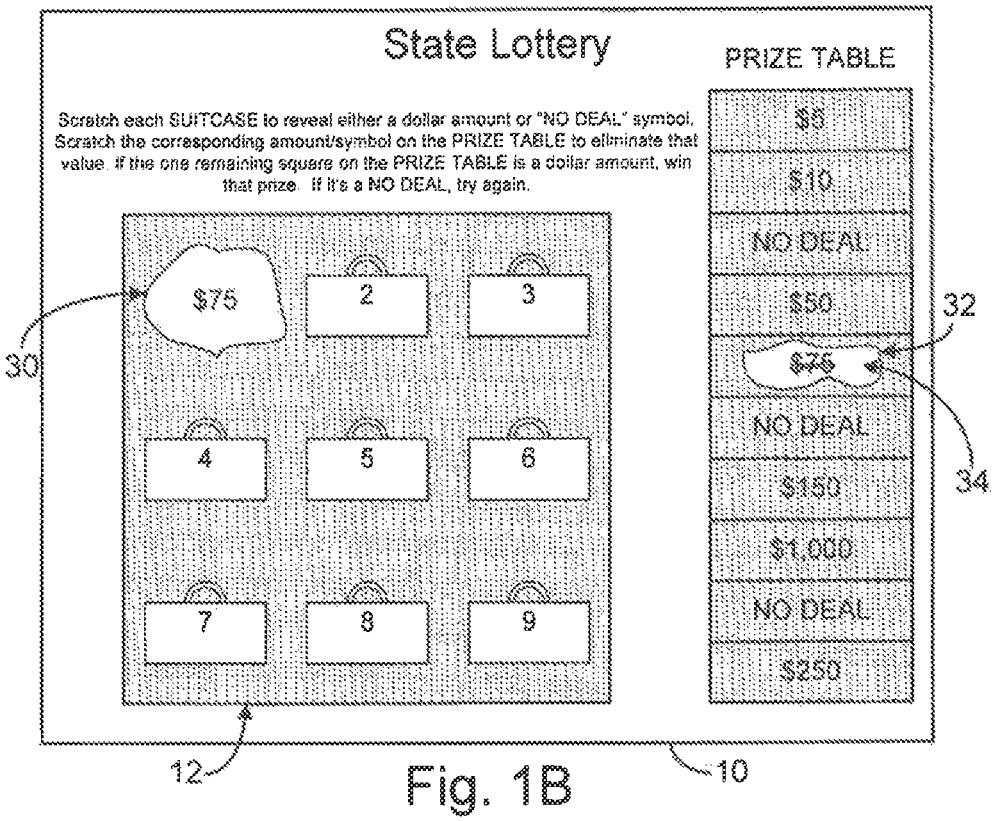
FIG. 1B is the lottery instant-game ticket of FIG. 1A with a position indicator scratched off and one of the identical symbols on the removable covering over the second set of indicia scratched off to reveal one of the second set of game symbols that also includes a non-winning indicator.
Figure 1C:
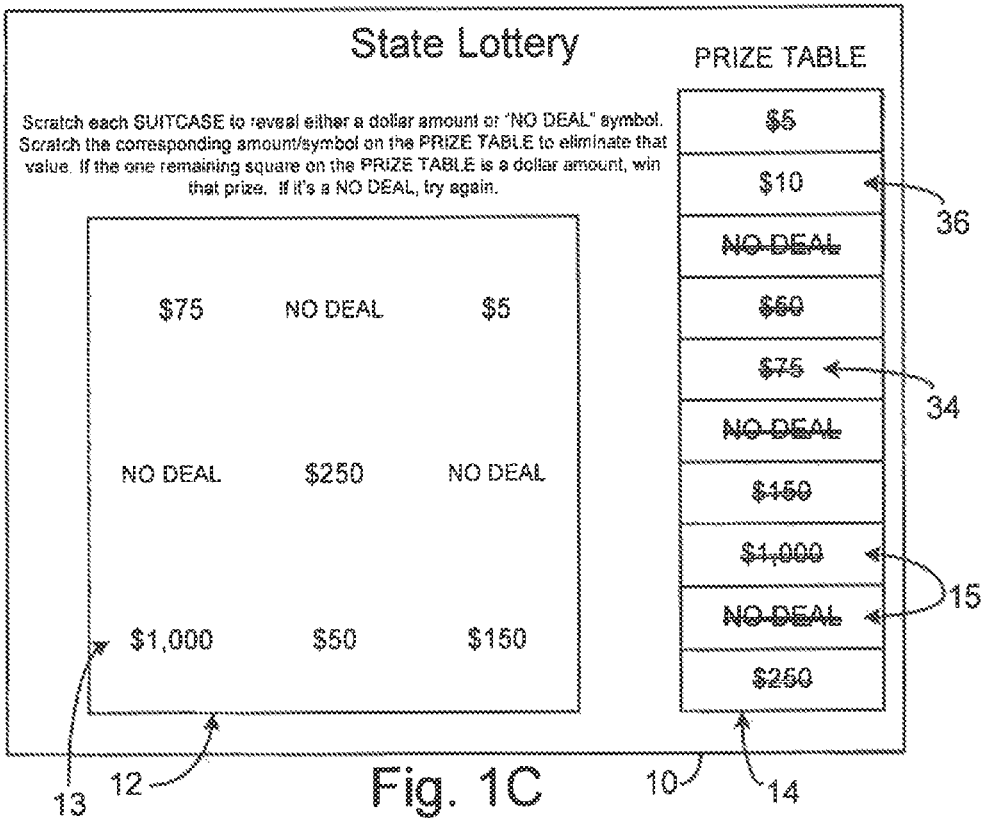
FIG. 1C is a plan view of the lottery game ticket of FIG. 1A with the scratch-off coating removed.

The present invention discloses a novel lottery or a promotional instant-game ticket, and a method of making the card or ticket. As shown in FIGS. 1A-1C, the lottery instant-game ticket 10 includes a substrate 11 having a first set of game indicia 12 placed on the substrate 11, with the first set of game indicia 12 including a first set of game symbols 13. The substrate 11 includes a second set of indicia 14 larger in number than the first set of game indicia 12 and comprised of a second set of game symbols 15, with a subset of the second set of game symbols 14 identical to a subset of the first set of game symbols 13, and a subset of the second set of game indicia 14 each including a non-winning indicator 34. The first set of game indicia 12 is covered with a removable covering 16 that includes position indicators 18 that are positioned substantially over each of the first set of game indicia 12 such that removal of the removable material at the position indicator 18 reveals a game symbol of the first set of game indicia 12, as is shown at scratched-off portion 30 in FIG. 1B by scratching off of position indicator "suitcase 7."

The second set of game indicia 14 is covered with a removable covering 20 that contains identical game symbols 22,24 to the second set of game symbols 15, with the identical game symbols 22,24 positioned substantially over a corresponding identical game symbol of the second set of game indicia 14 whereby, as shown in FIG. 1B at scratch-off spot 32, removal of the identical game symbol on the removable material 20 will reveal the identical game symbol of the second set of game indicia 14 and corresponding non-winning indicator 34, if present. Upon removal of the removable material 20 over the second set of game indicia 14, a winning ticket is indicated by at least one winning game symbol 36 present in the second set of game indicia 14. A winning symbol 36 is shown here as not have a strike-through non-winning indicator 34.

The ticket 10 is comprised of a substrate upon which data is imaged, some of this data being predetermined and fixed in nature, for example the game name, the sponsoring entity and game play instructions 26, and with some of the data being variably imaged as is known in the art. The ticket 10 is printed in known fashion using the known types of inks, and includes a removable "latex" or other polymer scratch-off layer (such removable coverings 16,20) which overlies and securely conceals the variably imaged data, this scratch-off layer being comprised of known types of elastomeric coatings.

Thus, to play the instant game, the player exposes "X" number of play symbols (the game symbols may be prize amounts 22 or words 24) in the first of two play areas. For every play symbol revealed in the first play area (set of first indicia 12), the player marks that symbol on the second play (set of second indicia 14) area as "eliminated". In the second play area there preferably are "X+1" number of play symbols and an associated prize value (such as winning symbol 36). Therefore, in this embodiment, the player will eliminate all but one of the game symbols 15 in of the second set of indicia 14. That last remaining symbol will have a prize value or no prize value, depending upon whether or not it is a winning ticket. Thus, if one is left with "NO DEAL" as the last symbol of the second set of game indicia 14, it is a losing ticket.

The first set 12 and second set 14 of game symbols can include dollar amounts, such as winning indicator 36, or can include words, such as identical game symbol 24. As shown in FIG. 1C, the instant-win ticket 10 has a winning game symbol 36 that is a dollar amount without a non-winning indicator 34.

Figure 2A:
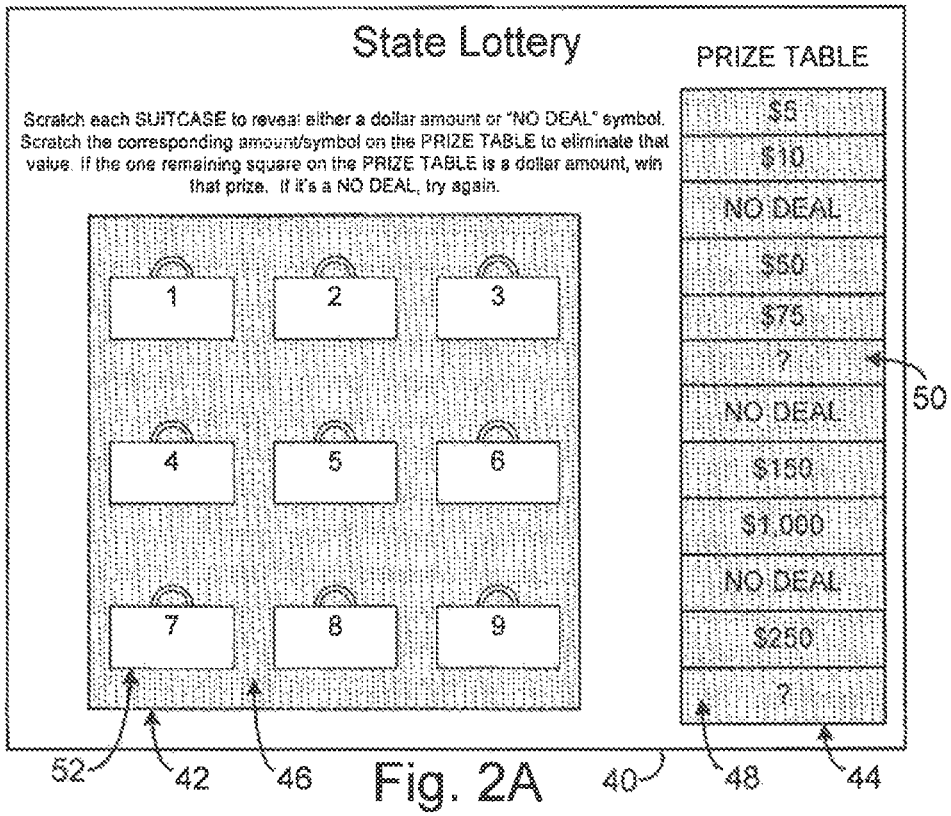
FIG. 2A is an illustration of an alternate embodiment of the lottery instant-game ticket including several potential multiplier spaces with the second set of indicia.
Figure 2B:
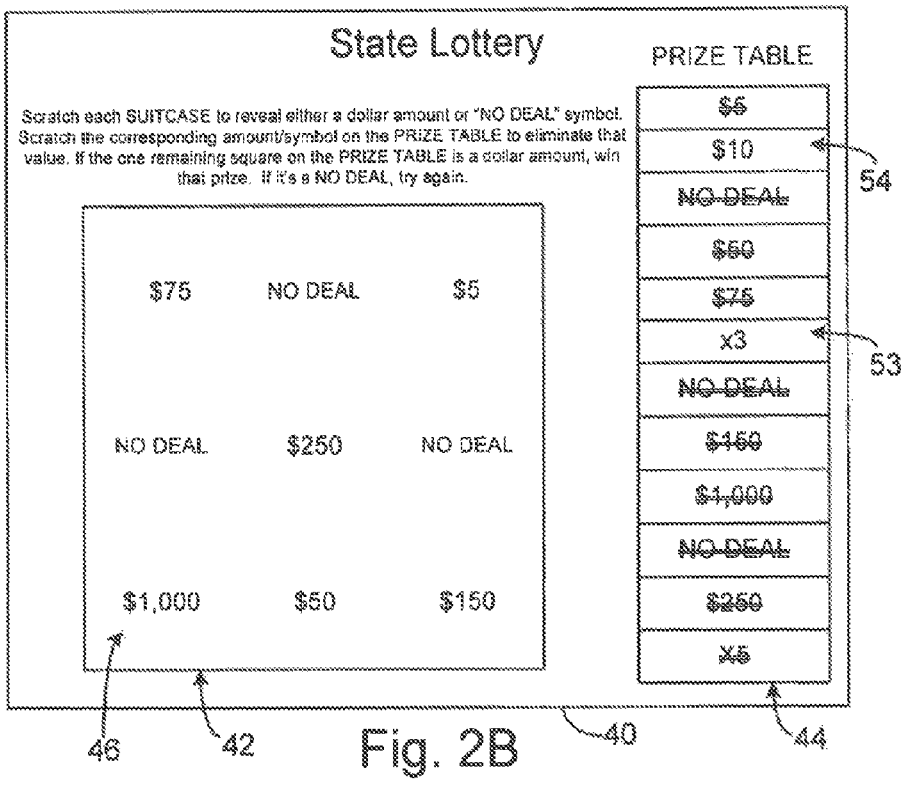
FIG. 2B is a plan view of the lottery instant-game ticket of FIG. 2A with the scratch-off coating removed revealing the first set and second set of game indicia, and the prize multiplier present within the second set of indicia.

In another embodiment shown in FIG. 2A-2B, the instant-win ticket 40 includes a first set 42 and second set 44 of game indicia, with a first removable covering 46 with position indicators 52, and second removable cover 48. However, there are two or more of the second set of game indicia 44 without a non-winning indicator 34, such as winning symbol 52 and multiplier 53. In this embodiment, the second set of game symbols includes one or more multiplier spaces 50 for the player to scratch. Such spaces could also include other potential bonuses or money amounts or prizes (such as cars or other items), and does not only need to be a multiplier 53 that multiplies a winning game symbol dollar amount when both the multiplier 53 and the winning game symbol 54 are present in the second set of game indicia 44.

It can thus be seen from the Figures that the present invention also provides a method for making an instant-game ticket 10 through placing a first set of game indicia 12 on a substrate 11, with the first set of game indicia 12 including a first set of game symbols 13, and then placing a second set of indicia 14 on the substrate 11 larger in number than the first set of game indicia 12 and comprised of a second set of game symbols 15, with a subset of the second set of game symbols 15 identical to a subset of the first set of game symbols 13, and a subset of the second set of game indicia 14 each including a non-winning indicator 34. The method then has the step of covering the first set of game indicia 12 with a removable covering 16 that includes position indicators 18 that are positioned substantially over each of the first set of game indicia 12 such that removal of the removable material 16 at the position indicator 18 reveals a game symbol of the first set of game indicia 12 (as shown at scratch-off spot 30), and covering the second set of game indicia 14 with a removable covering 20 that contains identical game symbols (such as identical symbols 22,24) to the second set of game symbols 15, with the identical game symbols are positioned substantially over a corresponding identical game symbol of the second set of game indicia 14 such that removal of the identical game symbol on the removable material 20 will reveal the identical game symbol of the second set of game indicia 14 and corresponding non-winning indicator 34, if present, as shown at scratch-off spot 32.

The foregoing descriptions present only exemplary embodiments. Those of ordinary skill in the art will readily recognize that the invention may be embodied in a variety of ways by varying the geometric figures, the plurality of positions within the figure, the plurality of positions selected by the player, the symbols, the plurality of symbols, the plurality of instances of each symbol, the assignment of point values to the symbols, and the prize table. In particular it is easily seen that an important special case of the invention is a lottery game where all the indicia are identical or have equal point values. These variations are contemplated as being within the scope of the present invention.

What is claimed is:

1. A method for manufacturing an instant-game ticket, comprising the steps of:

placing a first set of game indicia on a substrate, the first set of game indicia comprised of a first set of game symbols;

placing a second set of indicia on the substrate, the second set of game indicia larger in number than the first set of game indicia and comprised of a second set of game symbols, wherein a subset of the second set of game symbols are identical to a subset of the first set of game symbols, and wherein a subset of the second set of game indicia contains a non-winning indicator;

covering the first set of game indicia with a removable covering, the removable covering including position indicators that are positioned substantially over each of the first set of game indicia such that removal of the removable covering at the position indicator reveals a game symbol of the first set of game indicia;

covering the second set of game indicia with a removable covering, the removable covering containing identical game symbols to the underlying second set of game symbols, the identical game symbols positioned substantially over a corresponding identical game symbol of the second set of game indicia such that removal of the identical game symbol on the removable covering will reveal the identical game symbol of the second set of game indicia and corresponding non-winning indicator, if present.

2. The method of claim 1, wherein the step of placing the first set of game indicia and the second set of game indicia on the substrate further includes placing a first set of game symbols and a second set of game symbols on the substrate that include dollar amounts.

3. The method of claim 1, wherein the step of placing the first set of game indicia and the second set of game indicia on the substrate further includes placing a first set of game symbols and a second set of game symbols on the substrate that include words.

4. The method of claim 1, further comprising the step of placing a winning game symbol on the substrate as a dollar amount without a non-winning indicator in the second set of game indicia.

5. The method of claim 4, further comprising the step of placing two or more of the second set of game indicia on the substrate without a non-winning indicator.

6. The method of claim 5, further comprising the step of placing a multiplier within the second set of game symbols on the substrate that multiplies a winning game symbol when both the multiplier and the winning game symbol are present in the second set of game indicia.

7. The method of claim 1, wherein the step of placing the first set of game indicia and the second set of game indicia on the substrate further comprises placing a first set of game symbols that match a subset of second game symbols, and placing the second set of game indicia for the subset of second game symbols such that each are having non-winning indicators.

8. The method of claim 1, further comprising placing at least one of a sponsoring entity, a game name, and game play instructions on the substrate.

* * * * *